United States Patent [19]

Nelson

[11] 4,376,346

[45] Mar. 15, 1983

[54] PERPETUAL CALENDAR

[76] Inventor: Milton T. Nelson, 4818 Lema Ct., North Fort Myers, Fla. 33903

[21] Appl. No.: 313,980

[22] Filed: Oct. 22, 1981

[51] Int. Cl.[3] ..... G09D 3/06; G09D 3/10; G09F 3/00

[52] U.S. Cl. ..... 40/114; 40/111; 40/109; 40/335

[58] Field of Search ..... 40/109, 111, 112, 113, 40/114, 115, 335

[56] References Cited

U.S. PATENT DOCUMENTS

| | | | |
|---|---|---|---|
| 475,156 | 5/1892 | Roe | 40/114 |
| 1,063,814 | 6/1913 | McGovern | 40/335 |
| 1,571,828 | 2/1926 | White | 40/335 |
| 1,692,392 | 11/1928 | Stevenson | 40/111 |
| 2,567,395 | 9/1951 | Peterson, Jr. | 40/111 |
| 3,731,415 | 5/1973 | Shore | 40/114 |

FOREIGN PATENT DOCUMENTS

| | | | |
|---|---|---|---|
| 1250871 | 10/1971 | United Kingdom | 40/111 |

*Primary Examiner*—Robert Peshock
*Assistant Examiner*—Michael J. Foycik
*Attorney, Agent, or Firm*—Harvey B. Jacobson

[57] ABSTRACT

First and second superposed members are mounted for relative back and forth movement along a predetermined path and one of the members has a generally rectangular window formed therein. The other of the members includes number indicia arranged in seriatim repetitively in coordinates of seven extending along the path with the coordinates spaced transversely of the path. The window is of a dimension transverse to the path to view the six laterally spaced coordinates of indicia therethrough and of a dimension longitudinally of the path to view seven indicia in each coordinate. A view masking panel is disposed intermediate the first and second members and includes a pair of elongated side-by-side indicia masking zones thereof extending along the path and including one pair of corresponding ends facing in one direction along the path and staggered lengthwise relative to the path a distance equivalent to at least seven of the indicia spaces. The view masking panel is shiftable along the path relative to the first and second members and may be utilized to selectively mask portions of two of the coordinates of indicia spaces extending along one side of the aforementioned path.

14 Claims, 6 Drawing Figures

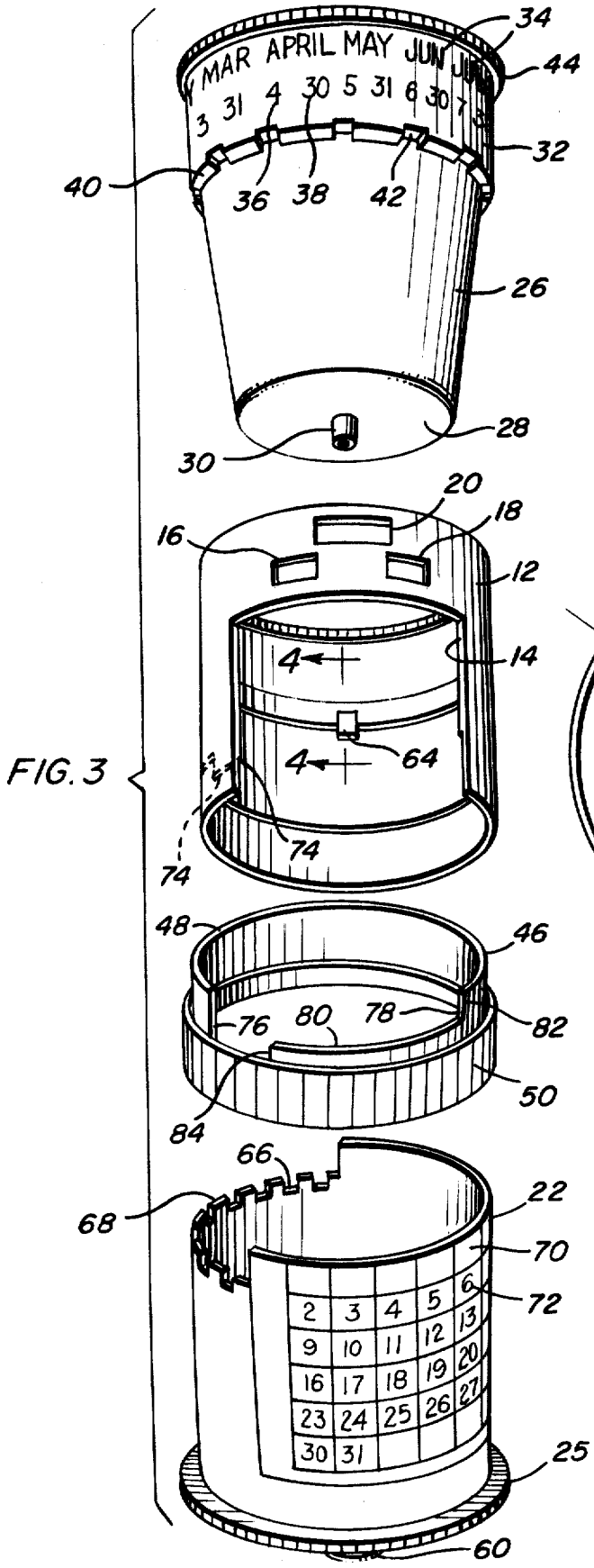
FIG. 3
FIG. 4
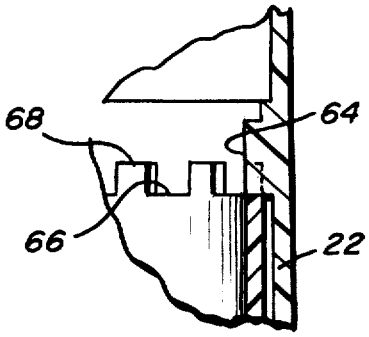
FIG. 5
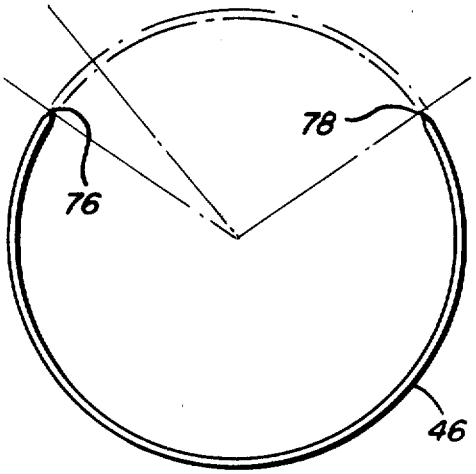
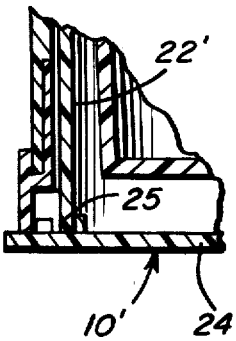
FIG. 6

PERPETUAL CALENDAR

BACKGROUND OF THE INVENTION

Various forms of perpetual calendars heretofore have been provided, but many are confusing to those persons who find it difficult to remember the number of days which occur in each specific month. Perpetual calendars usually include a viewing window or area through which 42 day spaces may be viewed and a portion of the calendar disposed behind the viewing window has 57 month day indicia thereon arranged in seriatim repetitively in coordinates of seven and the aforementioned calendar portion is shiftable relative to the window in order that the desired total number of month days may be registered with the viewing window. The shiftable calendar portion must be adjusted to a particular position for each month in order that the first day of the month may start on the correct day of the week and after once being correctly adjusted, the day numbers of that month each are correctly positioned according to the days of the week. However, inasmuch as some months have 28, 29, 30 or 31 days, the month day numerals must include as many as 31 month day numerals registered with the aforementioned window and if that month has only 28, 29 or 30 days, the calendar is incorrect at the end of the month indicating at least one extra day in the month causing some persons to be confused by the extra day or a plurality of extra days.

Accordingly, a need exists for a perpetual calendar which may be properly set according to the number of days in a month independent of whether that month includes 28, 29, 30 and 31 days.

Examples of previously known forms of perpetual calendars including some of the structural and operational features of the instant invention are disclosed in U.S. Pat. Nos. 45,064, 201,831, 304,340, 1,692,392 and 2,567,395.

BRIEF DESCRIPTION OF THE INVENTION

The perpetual calendar of the instant invention is constructed in a manner whereby the calendar may be adjusted in order that each month displayed by the calendar will have only the correct number of month days indicated thereby. The perpetual calendar may be constructed in various forms, but the preferred form is that of a cylindrical member whose interior may be utilized for storage of various items.

The main object of this invention is to provide a perpetual calendar of the month day display type and constructed in a manner whereby the correct number of month days may be displayed for each month.

Another object of this invention is to provide a perpetual calendar in accordance with the preceding object indicating the number of month days which occur in each month to facilitate proper setting of the calendar for each month.

Another very important object of this invention is to provide a perpetual calendar whose adjustment features enable the calendar to be properly set by persons having minimal experience with perpetual calendars.

A final object of this invention to be specifically enumerated herein is to provide a perpetual calendar in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is an exploded perspective view of the calendar;

FIG. 4 is an enlarged fragmentary vertical sectional view taken substantially upon the plane indicated by the section line 4—4 of FIG. 3;

FIG. 5 is a schematic view illustrating the relative angular displacement of the stop surfaces of month day blanking member; and FIG. 6 is a fragmentary vertical sectional view illustrating a modified two-piece form of month day sleeve.

DETAILED DESCRIPTION OF THE INVENTION

Figure 1:
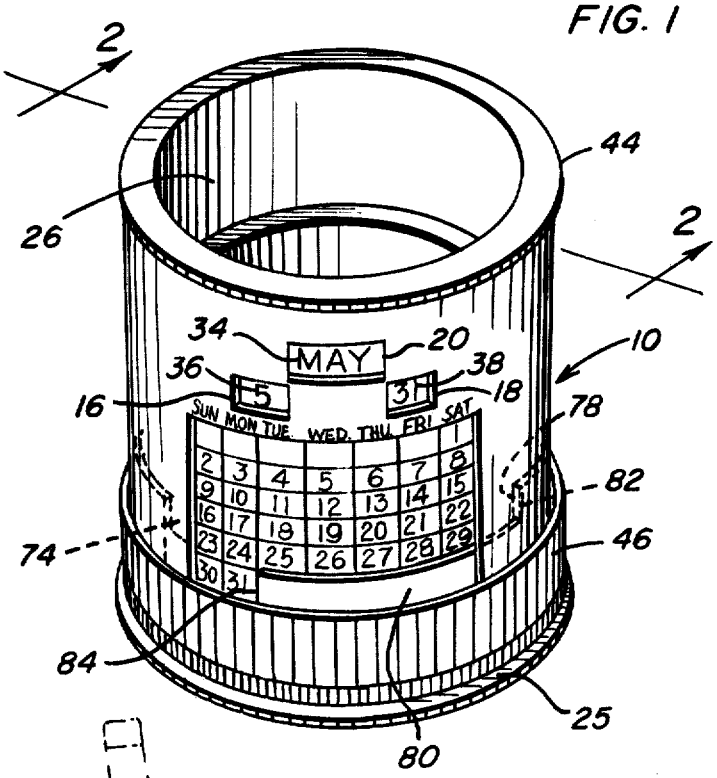
FIG. 1 is a perspective view of the perpetual calendar of the instant invention.

Referring now more specifically to the drawings, the numeral 10 generally designates the perpetual calendar of the instant invention. The calendar 10 includes a first cylindrical member 12 having a first large viewing window 14 formed therein in addition to a pair of circumferentially spaced small viewing windows 16 and 18 and a slightly larger intermediate size viewing window 20 formed therein. The calendar also includes a second cylindrical member 22 of slightly smaller outside diameter than the inside diameter of the first member 12 and the member 22 includes a lower end bottom wall 24 which projects radially outwardly of the lower end of the cylindrical member 22 and defines an upwardly facing abutment shoulder 25.

The calendar 10 additionally includes an upwardly opening cup member 26 including a bottom wall 28 having a depending stud 30 formed integrally therewith. The cup member 26 includes an enlarged upper cylindrical portion 32 having month name indicia 34 thereon as well as year month indicia 36 and month day indicia 38 thereon. The indicia 34, 36 and 38 are spaced circumferentially about the cylindrical portion 32 and the lower extremity of the cylindrical portion 32 defines a downwardly opening shoulder 40 having circumferentially spaced notches 42 formed therein. The upper end of the cup member 26 includes a radially outwardly projecting circumferential abutment flange 44.

The calendar 10 additionally includes a cylindrical masking ring 46 and the masking ring 46 includes a small diameter upper cylindrical portion 48 and a lower larger diameter cylindrical portion 50. The upper and lower portions 48 and 50 are joined by an integral annular portion 52 which joins the lower marginal portion of the upper portion 48 to the lower portion 50 a spaced distance below the upper marginal edge thereof in a manner defining an upwardly opening channel 54 between the upper marginal portion of the lower portion 50 and the lower marginal portion of the upper portion 48.

Figure 2:
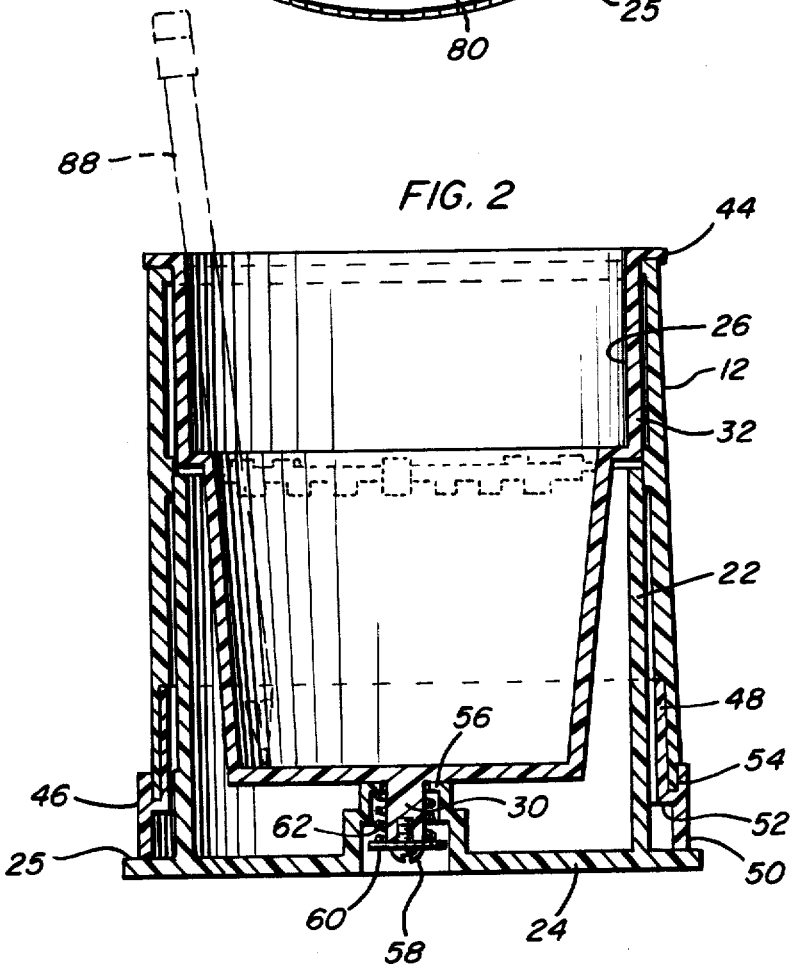
FIG. 2 is a fragmentary enlarged vertical sectional view taken substantially upon the plane indicated by the section line 2—2 of FIG. 1.

The masking ring 46 is of greater inside diameter than the outside diameter of the cylindrical member 22 and is telescoped downwardly thereover with the lower marginal edge of the lower portion 50 abutting the shoulder 25 in the manner illustrated in FIG. 2 of the drawings. Then, the first cylindrical member 12 is telescoped downwardly over the second cylindrical member 22 with the lower marginal edge of the first vertical member 12 received in the channel 54. Thereafter, the cup member 26 is downwardly telescoped into the upper end of the first cylindrical member 12 to a position with the underside of the abutment flange 44 abutting the upper end of the second cylindrical member 12. The shank 30 is downwardly received through an upwardly offset and apertured central portion 56 of the bottom wall 24 and secured therethrough by a fastener 58, a washer 60 and a compression spring 62. Accordingly, the compression spring 62 yieldingly biases the cup member 26 downwardly to a position with the undersurface of the flange 44 thereof frictionally engaged with the upper marginal edge of the cylindrical member 12.

The interior of the first member 12 includes a stop 64 including an upper portion engageable in a selected notch 42 and a lower portion engageable in a selected notch of the peripheral spaced notches 66 formed in a reduced height peripheral portion 68 of the upper marginal edge of the second cylindrical member 22. Accordingly, the spring 62, the stop 64 and the notches 42 and 66 serve to releasably key the first cylindrical member 12, the second cylindrical member 22 and the cup member 26 in selected relatively rotated positions whereby selected peripherally extending arc portions of the members 12, 22 and 26 may be shifted back and forth relative to each other along radially registered arcuate paths. If it is desired to rotate the first cylindrical member 12 relative to the second cylindrical member 22, the first cylindrical member 12 is upwardly displaced against the biasing action of the spring 62 relative to the second cylindrical member 22 and rotated to the desired position. If it is desired to rotate the cup member 26 relative to the cylindrical members 12 and 22, the flange 44 is upwardly displaced relative to the cylindrical member 12 and rotated relative thereto.

With attention now invited more specifically to FIG. 3 of the drawings, it may be seen that the second cylindrical member 22 includes 78 month day spaces 70 formed thereon. Selected spaces 70 are provided with month day indicia 72 equally 57 in number and the numbers are arranged in seriatim repetitively in coordinates of seven. The arrangement of spaces 70 and indicia 72 may be identical to that shown in FIG. 5 of the drawings of U.S. Pat. No. 2,567,395, to T. F. Peterson, Jr., dated Sept. 11, 1951.

The spaces 70 are, of course, registrable with the window 14 and it may be seen from FIG. 3 of the drawings that the first cylindrical member 12 includes a stop 74 with which stop surfaces 76 and 78 of the masking ring 46 are engageable to limit angular displacement of the masking ring 46 relative to the first cylindrical member 12. In addition, it will be noted that the masking ring 46 defines a pair of circumferentially staggered and axially spaced masking strips 80 and 82, the surface 78 defining the leading end of the masking strip 72 and the surface 84 defining the leading end of the masking strip 80.

With attention now invited more specifically to FIG. 6 of the drawings, there will be seen a modified form of calendar referred to in general by the reference numeral 10' wherein the bottom wall 24' thereof is formed separately from the second cylindrical member 22' thereof and cemented to the latter as at 25. However, construction of the second cylindrical member 22 and the bottom wall 24 as integral components is preferable.

In operation, the calendar 10 may be adjusted, for example, to register the indicia 34 indicating the month of May with the intermediate size window 20 and the corresponding indicia 36 and 38 indicating the fifth month of the year and 31 days in the month registered with the windows 16 and 18. Thereafter, the first cylindrical member 12 may be rotated relative to the second cylindrical member 22 in order to position the indicia 72 indicating the first day of the month as starting on Saturday (as will occur in the year 1982). Then, the masking ring 46 is turned to the position thereof with the stop surface 76 engaging the stop 74 to automatically enable the masking strip 80 to mask all of the spaces 70 which occur after the numeral 72 indicating the 31st day of the month in the Monday column, see FIG. 1. Of course, other adjustments of the calendar 10 may be made for each month of each year in a similar manner.

By masking over those indicia 72 indicating excessive days of a month, confusion is eliminated at the end of the month.

It will be noted that the window 14 has six horizontal rows of spaces 70 registered therewith and that either four, five or six rows of spaces are needed. Accordingly, the two masking strips 80 and 82 serve to provide the necessary full or partial masking of the lower two rows of spaces 70 as required.

As may be seen in FIG. 3 of the drawings, each of the indicia 34 has a corresponding pair of indicia 36 and 38 associated therewith for registry with the windows 16 and 18 and it will be further noted from FIG. 2 of the drawings that the cup member 26 may be used to store any suitable form of article 88. Also, the various components of the calendar 10, other than the spring 62 and fastener 58, are constructed of plastic and the various relatively movable components of the calendar 10 are provided with suitable bearing or guide surfaces facilitating ease in relative movement of the various components.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A perpetual calendar including first and second superposed panel member portions mounted for relative back and forth movement along a predetermined path, one of said panel member portions having a generally rectangular window formed therein, the other of said panel member portions including number indicia arranged thereon in seriatim repetitively in coordinates of seven extending along said path and including rows of indicia spaced transversely of said path, said window being of a dimension transverse to said path to view six laterally spaced rows of spaces therethrough and of a dimension longitudinally of said path to view seven indicia spaces in each row, and a single view masking panel member portion disposed intermediate said first and second panel member portions and including a pair of elongated side-by-side indicia space masking strip portions extending along said path and including one pair of corresponding ends facing in one direction along said path and staggered lengthwise of the latter a distance equivalent to at least seven of said indicia spaces, said view masking strip portions being manually shiftable along said path to selectively mask the two rows of spaces adjacent one longitudinal side of said window.

2. The calendar of claim 1 wherein said first and second panel member portions comprise relatively rotatable and telescoped cylindrical members, said view masking panel comprises a cylindrical member interposed between said first and second cylindrical members and said back and forth movement comprises relative angular oscillation of said cylindrical members about concentric axes.

3. The calendar of claim 1 including a fourth cylindrical member telescopingly engaged with and rotatable relative to said first cylindrical member, said first cylindrical member including three additional windows formed therein, said fourth cylindrical member including 12 sets of month, year month and month day indicia formed thereon, said sets of indicia being selectively registrable with said three additional windows.

4. The calendar of claim 3 including coacting detent means carried by said first and second cylindrical members operative to releasably retain said first and second cylindrical members in predetermined relatively rotated positions.

5. The calendar of claim 4 wherein said fourth cylindrical member and said first cylindrical member also include coacting detent means operative to releasably retain said fourth cylindrical member in predetermined rotated positions relative to said first cylindrical member.

6. The calendar of claim 1 wherein said first and second panel member portions include coacting detent means operative to releasably retain said first and second panel member portions in predetermined shifted positions relative to each other.

7. The calendar of claim 1 wherein said first cylindrical member includes three additional windows formed therein, a fourth cylindrical member shiftably supported from said first cylindrical member and including 12 sets of month, year month and month total days indicating indicia thereon, said sets of indicia being selectively registrable with said three additional windows.

8. The calendar of claim 7 wherein said first and fourth cylindrical members include coacting detent means operative to releasably retain said first and fourth members in predetermined adjusted shifted positions.

9. A perpetual calendar including an upstanding cylindrical body, a first generally cylindrical and upwardly opening cup member rotatably and snugly telescopingly received in the upper end of said body and including an upper end outwardly projecting flange downwardly abutted against an upwardly facing peripherally extending surface defined by said cylindrical body, a second upwardly opening and generally cylindrical cup member rotatably and snugly telescopingly received in the lower end of said body and including a lower end outwardly projecting flange upwardly abutted against a downwardly facing peripherally extending surface defined by said body, spring means operatively associated with and yieldingly resisting upward and downward displacement of said first and second cup members, respectively, relative to said body, said body and cup members including coacting detent means operative to releasably lock said cup members in predetermined rotated positions relative to said body and to allow selective rotation of said cup members relative to said body upon upward and downward displacement of said first and second cup members, respectively, relative to said body, said body having a small area month indicating viewing window formed therein and a large viewing window formed therein, said upper cut members including month indicating indicia formed thereon and spaced thereabout selectively registrable with said small month indicating viewing window, said lower cup member including number indicia arranged thereon in seriatim repetitively in coordinates of seven extending about said cup member and including vertically spaced rows of indicia, said large viewing window being of a vertical dimension to view six vertically spaced rows of spaces therethrough and of an angular dimension to view seven indicia spaces in each row.

10. The calendar of claim 9 wherein each of said cup members includes a bottom wall, said spring means comprises a spring connected between central portions of said bottom walls.

11. The cup of claim 9 wherein said body has additional small area month day and week day viewing windows formed therein, said upper cup including month day and week day indicating indicia formed thereon and spaced thereabout each selectively registrable with said additional viewing windows.

12. The calendar of claim 9 wherein said cylindrical body includes an upper portion in which said month indicating viewing window and said large viewing window are formed and a lower portion telescopingly and rotatably engaged with the lower end of said upper portion, said lower portion including elongated side-by-side indicia space masking strip portions extending peripherally about said lower portion and including one pair of corresponding ends spacing in one direction thereabout and staggered about the periphery of said lower portion a distance equivalent to at least seven of said indicia spaces, said lower portion being angularly displaceable relative to said cylindrical body and cup members to selectively mask the lower two rows of spaces.

13. The calendar of claim 12 wherein said lower end flange is upwardly abutted against the lower end of said lower portion.

14. A perpetual calendar including first and second relatively telescopingly and rotatably engaged generally cylindrical members mounted for angular oscillation relative to each other, the outer cylindrical member having a generally rectangular window formed therein, the inner cylindrical member including number indicia arranged thereon in seriatim repetitively in coordinates of seven extending about the circumference of said inner cylindrical member and including rows of indicia spaced axially of said inner cylindrical member, said window being of a dimension axially of said outer cylindrical member to view six axially spaced rows of indicia therethrough and of an angular dimension about said outer cylindrical member to view seven indicia spaces in each row, a single generally cylindrical masking panel member disposed intermediate the first and second cylindrical members including a pair of elongated side-by-side indicia space masking strip portions extending peripherally thereabout and including one pair of corresponding ends facing in one direction thereabout and staggered lengthwise therealong a distance equivalent to at least seven of said indicia spaces, said masking panel member being manually angularly displaceable relative to said first and second cylindrical members to selectively mask two rows of spaces adjacent one edge of said window extending about said outer cylindrical member.

* * * * *